US005344732A

United States Patent [19]

Chiba et al.

[11] Patent Number: 5,344,732

[45] Date of Patent: Sep. 6, 1994

[54] MULTI-COLOR ELECTROPHOTOGRAPHIC IMAGE FORMATION METHOD

[75] Inventors: Shunichi Chiba, Kawasaki; Nobuhiro Nakayama, Susono; Yasuo Asahina, Numazu; Yosihisa Okamoto, Fuji; Kayo Makita, Numazu, all of Japan

[73] Assignee: Ricoh Company, Ltd., Tokyo, Japan

[21] Appl. No.: 56,826

[22] Filed: Jun. 30, 1993

Related U.S. Application Data

[63] Continuation of Ser. No. 672,484, Mar. 20, 1991, abandoned.

[30] Foreign Application Priority Data

Mar. 22, 1990 [JP] Japan ..... 2-69665

[51] Int. Cl.[5] ..... G03G 13/16

[52] U.S. Cl. ..... 430/42; 430/45; 430/46; 358/500

[58] Field of Search ..... 430/42, 45, 46; 358/75

[56] References Cited

U.S. PATENT DOCUMENTS 4,199,356 4/1980 Matsumoto et al. ..... 430/122
4,609,928 9/1986 Kubo et al. ..... 503/207
4,762,763 8/1988 Nomura et al. ..... 430/110
4,831,409 5/1989 Tatara et al. ..... 358/79
4,908,287 3/1990 Fukuchi et al. ..... 430/42
4,959,695 9/1990 Nishimura et al. ..... 430/42

*Primary Examiner*—Marion E. McCamish
*Assistant Examiner*—Mark A. Chapman
*Attorney, Agent, or Firm*—Cooper & Dunham

[57] ABSTRACT

A multi-color electrophotographic image formation method of a digital type for forming multi-color images is disclosed, in which latent electrostatic images corresponding to yellow, magenta, cyan and black images separated from an original image are developed with a yellow developer, a magenta developer, a cyan developer and a black developer, respectively to form visible yellow, magenta, cyan and black images, and the visible yellow, magenta, cyan and black images are fixed to an image receiving member, with the reflection image density ($ID_{ref}$) and the transmission image density ($ID_{tr}$) of the fixed black images formed by the black developer being in the relationship of $ID_{ref} \geqq 1.8 \times ID_{tr}$ when the deposition of the black developer is in the range of 1.0 mg/cm$^2$ or less.

12 Claims, 1 Drawing Sheet

MULTI-COLOR ELECTROPHOTOGRAPHIC IMAGE FORMATION METHOD

This is a continuation of application Ser. No. 672,484, filed Mar. 20, 1991 now abandoned.

BACKGROUND OF THE INVENTION

1. Field of the Invention

This invention relates to an electrophotographic image formation method for use in the fields of electrophotography, electrostatic recording and electrostatic printing, and more particularly, to a multi-color electrophotographic image formation method of a digital type, capable of producing high quality multi-color or full-color images.

2. Discussion of Background

Although various electrophotographic image formation methods are disclosed, for example, in U.S. Pat. No. 2,227,691, and Japanese Patent Publications 42-23910 and 43-24748, the most common method is such that a latent electrostatic image is first formed on the surface of a photoconductive member and then developed with a developer (toner) to obtain a visible toner image, or when necessary, the thus obtained toner image is transferred to a sheet of paper or the like and then fixed thereon by application of heat or pressure, or both, or by the use of a vaporized solvent to obtain visible images.

A multi-color electrophotographic image formation method of an analogue type is disclosed, for example, in U.S. Pat. No. 2,962,374. In this method, the colors of an original image are separated and converted into electric signals corresponding to at least three colors of yellow, magenta and cyan, and the surface of a photoconductor is electrically charged in accordance with each of the color signals to form a latent electrostatic image corresponding to each of the separated colors, and each of the latent images is then successively developed with a corresponding color developer of yellow, magenta or cyan to obtain multi-color images.

In addition, various proposals are now being made on a multi-color electrophotographic image formation method of a digital type. In this method, an original image is subjected to color separation to obtain color signals, which are then subjected to an A/D conversion to obtain digital color signals. By conducting a predetermined computation, recording signals are obtained from the digital color signals, and latent electrostatic images are formed on the surface of a photoconductor in accordance with the digital signals. The latent electrostatic images are then developed with color developers to obtain visible multi-color images.

As described above, in the digital multi-color electrophotographic image formation method, the optical information is subjected to computation processing, so that a masking treatment and an undercolor removal (UCR) treatment can be carried out, which cannot be successfully carried out in the conventional multi-color electrophotographic image formation method of an analogue type.

In the case where the UCR treatment is conducted, a latent image corresponding to black color can be developed with a black developer to obtain a black image, instead of successively overlapping yellow, magenta and cyan toner images. The gray balance of the obtained images can thus be improved; in other words, excellent half-tone images are obtainable. In addition, the thickness of the toner layer of the black area obtained by using a black developer is thinner than that of the black area obtained by superimposing yellow, magenta and cyan images. The digital method is therefore economically advantageous, and can provide images without the problem of the curling of a transfer sheet.

A black developer for use in the multi-color electrophotographic image formation method, which is hereinafter referred to as a black developer for process color, is required to assume a black color just like the conventional black developer, which is widely used for a copying apparatus for producing black and white images, as a matter of course. In addition, the spectral reflectance characteristics of the black developer for process color is required to show the panchromatic absorption in the visible light range. According to the multi-color electrophotographic image formation method of a digital type, a black developer for process color is used to form a pictorial images as well as a character image by the UCR treatment. Therefore, the optical properties of the black developer for process color have significant effects on the image quality of the obtained images.

With the above-mentioned importance of the black developer for process color in the electrophotographic image formation method of a digital type taken into consideration, it is essential for the black developer to be provided with excellent color mixing properties, high transparency, adequate coloring power with sufficient gradation, and good image fixing properties.

The conventional black developers used in the copying apparatus for producing black and white images are designed for the purpose of reproducing mainly character images. Therefore, the above black developers are desired to produce images on a transfer sheet with a sufficient density only by a single layer of toner particles. Thus, the optical properties of such black developers, for example, the transparency, capabilities of exhibiting bright mixed-color and a controllability of a coloring power are almost ignored.

When the conventional black developers are used as black developers for a process color, not only the gradation of images becomes poor, but also color reproduction is adversely affected because the optical properties of the conventional black developers do not meet the requirements for the multi-color electrophotographic image formation.

Furthermore, the surface roughness of the obtained images, characteristic of the multi-color electrophotographic image formation method of a digital type, is unfavorably emphasized when used in the digital-type multi-color electrophotography. The reason for this is that the optical properties of the conventional black developers, such as transparency and the coloring power thereof are not considered. The conventional black developers are designed only in due consideration of the reflection density.

SUMMARY OF THE INVENTION

Accordingly, an object of the present invention is to provide a multi-color electrophotographic image formation method of a digital type, capable of forming high quality multi-color images on a transfer sheet with excellent gradation after UCR treatment.

Another object of the present invention is to provide a multi-color electrophotographic image formation method of a digital type which can produce multi-color images on a transfer sheet, with the surface roughness of the images being minimized, which is emphasized in the conventional digital-type multi-color electrophotographic image formation method.

The above objects of the invention can be attained by a multi-color electrophotographic image formation method of a digital type for forming multi-color images comprising the steps of developing latent electrostatic images corresponding to yellow, magenta, cyan and black images separated from an original image, with a yellow developer, a magenta developer, a cyan developer and a black developer, respectively to form visible yellow, magenta, cyan and black images, and fixing the visible yellow, magenta, cyan and black images to an image receiving member, with the reflection image density ($ID_{ref}$) and the transmission image density ($ID_{tr}$) of the fixed black images formed by the black developer being in the relationship (1) of $ID_{ref} \geqq 1.8 \times ID_{tr}$ when the deposition of the black developer is 1.0 mg/cm$^2$ or less.

DETAILED DESCRIPTION OF THE PREFERRED EMBODIMENTS

Figure 1:
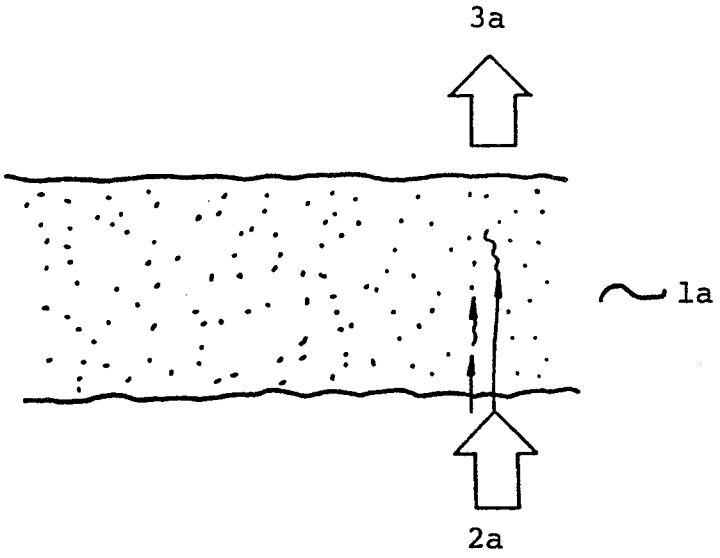
FIG. 1 is a view of a toner layer formed on a transfer sheet by a black developer for process color for use in the present invention.

In the present invention, the latent electrostatic images corresponding to yellow, magenta, cyan and black images can be formed by the steps of separating the colors of the original image, photoelectrically converting the colors into respective color signals, subjecting the color signals to an A/D conversion, and subjecting the A/D converted signals to a calculation processing to form the latent electrostatic images. Alternatively, the multi-color electrophotographic image formation method of a digital type of the present invention can be attained by the steps comprising, for instance:

(i) separating the colors of an original image into yellow, magenta, cyan, and black;

(ii) converting the separated colors into the respective color signals;

(iii) forming a latent electrostatic image corresponding to each of the separated colors on an electrophotographic photoconductor in accordance with the respective color signals;

(iv) developing the latent electrostatic images to yellow, magenta, cyan and black images by a yellow developer, a magenta developer, a cyan developer, and a black developer, respectively, to form developed yellow, magenta, cyan and black images;

(v) transferring the developed yellow, magenta, cyan and black images to a transfer sheet; and (vi) fixing the transferred yellow, magenta, cyan and black images onto the transfer sheet, if necessary, under application of heat or pressure thereto, with the relationship between the $ID_{ref}$ and the $ID_{tr}$ of the black image maintained as mentioned previously, that is, $ID_{ref} \geqq 1.8 \times ID_{tr}$.

As a result of intensive researches into the optical properties of a black developer for process color for use in a multi-color electrophotographic image formation method by the inventors of the present invention, it was discovered that high quality images can be obtained by the multi-color electrophotographic image formation method of a digital type in which the UCR treatment is conducted when the optical properties of a black developer for process color satisfies the above-mentioned relationship.

The reflection image density and the transmission image density of the obtained images are measured, for instance, using a copying apparatus equipped with a modified image fixing unit. More specifically, an unfixed image formed by a black developer is transferred onto a transparent polyester film. The unfixed image thus formed on the film is fixed thereon by an image fixing means. Thus, a sample image can be prepared. The toner deposition amount per unit area can be obtained by dividing the increase in weight of the polyester film after image formation by the area of the image.

The reflection image density and the transmission image density of the sample image are respectively measured by a commercially available reflection-type densitometer "RD-914" and a transmission-type densitometer "TD-904" (Trademark), made by Mcbeth Co., Ltd. In the measurement of the image densities, it is desirable that the density of the polyester film be cancelled. Particularly, for the measurement of the reflection image density of the sample image, it is recommended that a white plate with a high degree of whiteness, for example, made of magnesium oxide, be placed under the polyester film which carries the toner image thereon.

Several sample images are prepared, with the toner deposition amount changed, and the reflection image density and the transmission image density may be obtained by interpolation.

A binder resin contained in the black developer for process color becomes a key factor in order to satisfy the above-mentioned relationship between the reflection image density and the transmission image density of an image formed by the black developer for use in the multi-color electrophotographic image formation method of the present invention. For example, consideration of the thermal properties, rheological properties and transparency of the binder resin itself, and dispersion properties and compatibility of a coloring agent therewith is important to obtain the black developer for process color for use in the present invention.

In particular, it is indispensable to control the thermal properties and rheological properties of the developer in accordance with the image fixing means. When such control of the above properties of the black developer is insufficient, the neighboring toner particles constituting a toner image layer cannot completely melt into each other after the image fixing process, and the interfaces of those toner particles are unfavorably remained in a toner image layer. The light which passes through this toner layer is diffusely reflected by the above-mentioned interfaces of the toner particles, thereby lowering the transparency of the toner layer.

The aforementioned phenomenon will now be explained in detail by referring to FIGS. 1 and 2.

FIG. 1 shows a toner layer 1*a* formed on a transfer sheet by a black developer for process color for use in the present invention. In this figure, since the neighboring toner particles sufficiently melt into each other, there are no interfaces of toner particles in the toner layer 1*a*. In this case, an incident light 2*a* is not diffusely reflected in the toner layer 1*a*, the amount of a transmitted light 3*a* is large.

Figure 2:
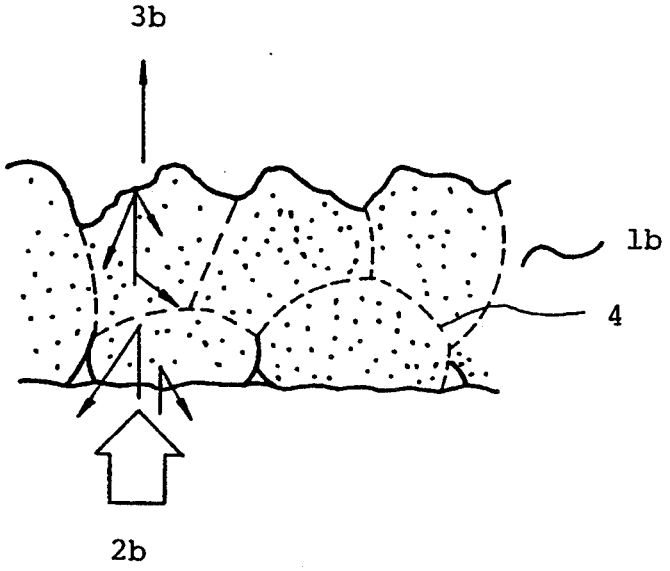
FIG. 2 is a similar view illustrating the condition where the neighboring toner particles do not sufficiently melt into each other.

On the other hand, in the case of FIG. 2, where the neighboring toner particles do not sufficiently melt into each other and the interfaces 4 thereof are remained in the toner layer 1b, an incident light 2b is diffusely reflected by the interfaces 4. As a result, the amount of a transmitted light 3b is decreased.

As for the rheological properties of the black developer for process color for use in the present invention, it is preferable that the viscoelasticity in terms of the loss tangent (tanδ) of the black developer for process color be greater than 2.8 and smaller than 3.8 at a storage modulus ($G'(\omega)$) of $10^5$ dyn/cm$^2$. When the loss tangent (tanδ) of the black developer is within the above range, the toner layer formed by the black developer on the transfer sheet can be provided with sufficient transparency, and at the same time, a hot off-set phenomenon can be avoided even at low temperatures.

The viscoelasticity of the black developer for use in the present invention can be measured by, for example, a commercially available product, "Rheometrics Dynamic Spectrometer RDS-7700 type" (Trademark), made by Rheometrics. Inc. in U.S.A.

As mentioned above, the dispersion properties of a coloring agent with a binder resin also becomes an important factor to obtain the black developer for process color for use in the present invention. The dispersion properties of a coloring agent with the binder resin can be enhanced by the aid of an appropriate dispersing agent, or the improvement of a dispersion method. More specifically, the dispersion properties can be improved by replacing a double-screw extruder, which is usually used as a kneader for kneading a toner composition, by a three-roll mill of which dispersion capability is superior to the above one.

The transparency of the binder resin is also a vital factor to obtain the black developer for use in the present invention.

It is preferable to select a binder resin which itself is transparent. In addition, when two or more resins are used in combination to improve the fixing properties of a toner layer to a transfer sheet, it is preferable to blend resins of the same type, with the refractive index, transparency and compatibility of each resin employed taken into consideration. Thus, a black developer for process color with high transparency can be obtained.

Furthermore, it is preferable that the coloring power of the black developer for process color be controlled so as to satisfy the following relationships (2) and (3):

$$0.8 < ID_{ref} < 1.3 \quad (2)$$

(at a toner deposition amount of 0.5 mg/cm$^2$)

$$1.6 < ID_{ref} < 2.4 \quad (3)$$

(at a toner deposition amount of 1.0 mg/cm$^2$)

In the above relationships (2) and (3), when the reflection image densities ($ID_{ref}$) of the toner layer formed by a black developer for process color are in the respective ranges as given, a sufficiently high image density for use in practice and excellent gradation can be obtained. In addition, it is preferable that both relationships (2) and (3) be satisfied for gradational addition of the colors.

The above-mentioned relationships between the toner deposition amount per unit area and the image density of a toner layer formed by a black developer for process color can be satisfied by controlling the coloring power of the employed black developer. As a result, the satisfactory gradation of images can be gained. At the same time, the surface roughness, characteristic of images formed by a digital-type image formation method, can be reduced, which increases the image quality.

The conventional black developers used in the copying apparatus for producing black and white images are desired to produce images with a sufficient density only by a single toner layer. To obtain a sufficient image density by a single toner layer, the above-mentioned black developers are designed to have remarkably high coloring power and hiding power. As a coloring agent for such black developers, carbon black and nigrosine dyes are mainly employed. The above-mentioned coloring agents have a remarkably strong coloring power. Therefore, a small amount of the coloring agent can impart a sufficient coloring power to the developer, theoretically. To impart the hiding power as well as the coloring power to the black developer, however, the coloring agent is contained in the developer beyond the saturation point, for practical use. As a result, the image density can attain to the maximum value by only a single toner layer when the conventional black developer is employed. However, it is difficult for such a black developer to produce images with a gradient by overlapping toner layers. In addition to the above, a highlight portion with a low image density cannot be expressed by the above conventional black developer because the coloring power of one particle of the developer is too strong.

The gradient in a highlight portion is regarded as a key feature of the pictorial image. Especially, the highlight portion is sensitively caught in the sense of sight. Therefore, the total image quality is decreased when the highlight portion in the images cannot be expressed with a proper gradient. Furthermore, since a shadow portion (with a high image density) is formed by overlapping toner layers, it is also required to properly increase a gradient as the toner layers are overlapped. Thus, the image quality becomes considerably poor when the conventional black developer is used for the aforementioned electrophotographic image formation method of a digital type.

The coloring power of the conventional black developer is too strong. Therefore, images appear nonuniform, with the surface roughness if a dot-image is formed on a transfer sheet with a slight deviation due to the malfunction in the development process or image transfer process. Namely, a trifling dust generated in the image transfer process results in the uneven image density in a dot-image from the microscopic viewpoint. When the coloring power of one toner particle is strong, the uneven image density is amplified, thereby increasing the surface roughness of images.

In the multi-color electrophotographic image formation method according to the present invention, it is necessary to control the mixing ratio of the coloring agent to the binder resin in order to adjust the coloring power of a black developer for process color and satisfy the above-mentioned relationships (2) and (3) between the toner deposition amount per unit area and the image density of a toner layer formed by the black developer.

It is preferable that any dye widely used as a coloring agent for a developer be selected with the compatibility thereof with the employed binder resin taken into consideration. It is necessary to consider not only the mixing ratio of the coloring agent to the binder resin, but also the kneading conditions when carbon black and nigrosine dyes, which have a strong coloring power, are used as the coloring agent for the developer.

In the present invention, further improved multicolor images can be obtained when the glossiness (Gs 60°) of a toner layer formed by the black developer for process color is higher than 10% and lower than 50%, at a toner deposition amount of 1.0 mg/cm$^2$.

The glossiness of the toner layer formed by the black developer for process color can be measured in accordance with the Test Method 3 of JIS-Z 8781 (1983) by, for example, a commercially available variable glossmeter "Model VGS-1D" (Trademark), made by Nippon Denshoku Co., Ltd.

When the glossiness of the toner layer formed by the black developer for process color is within the above-mentioned range, the maximum image density can be sufficiently increased to produce an impressive image, and at the same time, the image does not become extremely glossy.

There is a close relationship among the glossiness of a toner layer formed by the black developer for process color, the rheological properties thereof and the image-fixing means. By adjusting the rheological properties of the black developer and improving the image fixing means, a desirable glossiness can be obtained.

As mentioned previously, the rheological properties of the black developer has an important effect on the transparency thereof. In the present invention, it is preferable that the loss tangent (tan$\delta$) of the black developer for process color be greater than 2.8 but smaller than 3.8 at the storage modulus (G'($\omega$)) of $10^5$ dyn/cm$^2$. Therefore, it is preferable to employ the image-fixing means with improved releasability from the toner image transferred onto a transfer sheet. For instance, the toner image transferred on a transfer sheet may preferably be fixed thereon by a pair of silicone rubber-coated heat-application roller and a pressure-application roller.

The heat-application roller is composed of a metal hollow core drum made of aluminum, stainless steel, iron or copper, and a thin elastomer layer, provided on the outer surface of the metal drum, of RTV (room temperature vulcanized) silicone rubber or HTV (high temperature vulcanized) silicone rubber with a thickness of approximately 0.5 to 10 mm. The surface of the elastomer layer, which is brought into close contact with toner images, is made smooth so that fixed images can exhibit high glossiness.

The pressure-application roller, which is brought into pressure contact with the heat-application roller to form a nip when toner images are fixed, is made of a metal core drum whose outer surface is covered with an relatively thick elastic layer such as of silicone rubber, fluororubber or fluorosilicone rubber, or a relatively thin layer made of a heat resistant resin having releasing properties such as ethylene tetrafluoride.

The heat-application roller, and, if necessary, the pressure-application roller are heated by any of the conventional methods. In order to improve the releasability of the rollers, it is preferable to coat a liquid having releasing properties, such as silicone oil, onto the surface of the rollers.

The black developer for process color for use in the present invention comprises a binder resin and a coloring agent, and, if necessary, a charge controlling agent. The developer of the present invention can be prepared by any of the known methods.

It is preferable to use a polyester resin as the binder resin of the black developer for use in the present invention because it has high transparency. In addition, images formed by the black developer containing a polyester resin can be firmly fixed on a transfer sheet even when fixed at low temperatures. In particular, a polyester resin synthesized from a bisphenol-type diol and a polyvalent carboxylic acid is most preferred.

Examples of the bisphenol-type diol include polyoxypropylene (2,2)-2,2-bis(4-hydroxyphenyl)propane, polyoxyethylene (2)-2,2-bis(4-hydroxyphenyl)propane, polyoxystyrene (6)-2,2-bis(4-hydroxyphenyl)propane, polyoxybutylene (2)-2,2-bis(4-hydroxyphenyl)propane, polyoxypropylene (3)-bis(4-hydroxyphenyl)thioether, polyoxypropylene (2)-2,2-bis(4-cyclohexanol)propane, polyoxyethylene (2)-2,6-dichloro-4-hydroxyphenyl, polyoxyethylene (2,5)-p,p-bisphenol, polyoxybutylene (4)-bis(4-hydroxyphenyl)ketone, oxyethylene-2,2-bis(4-hydroxyphenyl)propane, and oxypropylene-2,2-bis(4-hydroxyphenyl)propane.

Furthermore, ethylene glycol, propylene glycol, 1,4-butane diol, 1,5-pentane diol, 1,6-hexane diol, glycerin, trimethylolethane, trimethylolpropane and aliphatic polyols such as penthaerythritol may be used as an alcoholic component, if necessary.

Examples of the polyvalent carboxylic acid include divalent aromatic carboxylic acids such as phthalic acid, isophthalic acid, phthalic anhydride, terephthalic acid and its derivatives such as terephthalic acid esters; trivalent aromatic polycarboxylic acids such as 1,2,4-benzene tricarboxylic acid, 1,2,5-benzene tricarboxylic acid, 1,2,4-naphthalene tricarboxylic acid and 2,5,7-naphthalene tricarboxylic acid, and anhydrides and esters of the trivalent aromatic polycarboxylic acids; tetravalent aromatic polycarboxylic acids such as 1,2,4,5-benzene tetracarboxylic acid, and anhydrides and esters thereof; divalent aliphatic carboxylic acids such as maleic acid, fumaric acid, succinic acid, adipic acid, sebatic acid and malonic acid; divalent organic acid monomers prepared by substituting the above divalent aliphatic carboxylic acids with a saturated or unsaturated hydrocarbon group having 8 to 22 carbon atoms, and anhydrides thereof; a dimer of a lower alkylester and linoleic acid; and monomers of other divalent organic acids.

In order to improve the properties of the black developer, such as the fluidity, non-filming property, crushability, chargeability and fixing ability, any known resins for use in a developer may be incorporated into the developer for use in the present invention, if necessary.

Examples of such resins include homopolymers of styrene or its substitution compound such as polystyrene, poly-p-styrene and polyvinyl toluene; styrene-based copolymers such as a styrene—p-chlorostyrene copolymer, a styrene—propylene copolymer, a styrene—vinyl toluene copolymer, a styrene—methylacrylate copolymer, a styrene—ethylacrylate copolymer, a styrene—butylacrylate copolymer, a styrene—methylmethacrylate copolymer, a styrene—ethylmethacrylate copolymer, a styrene—butylmethacrylate copolymer, a styrene—$\alpha$-chloromethylmethacrylate, a styrene—acrylonitrile copolymer, a styrene—vinylmethyl ether copolymer, a styrene—vinylmethyl ketone copolymer, a styrene—butadiene copolymer, a styrene—isoprene copolymer, a styrene—maleic acid copolymer and a styrene—maleic acid ester copolymer; polymethylmethacrylate, polybutylmethacrylate, polyvinyl chloride, polyvinyl acetate, polyethylene, polypropylene, polyurethane, polyamide, an epoxy resin, polyvinyl butyral, a polyacrylic acid resin, rosin, modified rosin, a terpene resin, a phenolic resin, an aliphatic resin, an aliphatic hydrocarbon resin, an aromatic petroleum resin, chlorinated paraffin and a paraffin wax. These resins can be used either singly or in combination.

The incorporation amount of the above resin is, in general, 30 wt. % or less of the weight of the binder resin. At any rate, the resin should not impede the effects of the present invention.

Any known coloring agents for a black developer can be used as the coloring agent of the black developer for use in the present invention.

Examples of black coloring agents include carbon black, aniline black, furnace black and lamp black. Two or more black coloring agents may be used in combination.

Any known charge controlling agents can be used in the black developer for use in the present invention, and among them colorless or white ones are preferably used because they do not lower the transparency of the black developer.

Examples of the charge controlling agent include organic metal compounds such as organic salts or complexes containing a polyvalent metal which is selected from Al, Ba, Ca, Cd, Cr, Cu, Fe, Hg, Mg, Mn, Ni, Pb, Sn, Sr and Zn. Of these, metal salts or metal complex salts of salicylic acid and salicylic acid derivatives are preferred.

The black developer for use in the present invention may further comprise auxiliary compounds, for example, a fluidity-imparting agent such as colloidal silica, an abrasive such as silicon carbide, or a metal oxidized compound, for instance, titanium oxide or aluminum oxide, and a lubricant such as a metal salt of fatty acids.

The black developer for use in the present invention can be used as either a one-component type developer or a two-component type developer together with a carrier.

In the case where the black developer is used as a two-component type developer, iron powder, nickel powder, ferrite powder, magnetite powder or glass beads having a diameter of 20 to 200 μm can be used as a carrier. Furthermore, the above metal powders and glass beads coated with a fluoroplastic, a silicone resin, a styrene resin or an acrylic resin can also be used.

When the above-described black developer is used in a multi-color electrophotographic image formation method according to the present invention, high quality images can be obtained.

More specifically, the color of an original image is separated into yellow, magenta, cyan and black, and the separated colors are converted into the respective color signals. A latent electrostatic image corresponding to each of the separated colors is formed on an electrophotographic photoconductor in accordance with the respective color signals, and then developed with each of the above-described color developers for use in the present invention. The developed yellow, magenta, cyan and black toner images are transferred to a transfer sheet.

In a series of the above steps, the effect of the above image formation method of the present invention can be further enhanced when the UCR treatment is conducted at an undercolor removal ratio of 40 to 100% in terms of the image density.

Other features of this invention will become apparent in the course of the following description of exemplary embodiments, which are given for illustration of the invention and are not intended to be limiting thereof.

EXAMPLE 1

[Synthesis of Polyester Resin]

A polyester resin was synthesized by condensing 7 moles of terephthalic acid, 2 moles of trimellitic acid and 9 moles of polyoxypropylene (2,2)-2,2-bis-(4-hydroxyphenyl)propane by a conventional method, with the utmost care that none of these monomers was distilled away or escaped from the reaction system or with replenishment of the necessary components by the amount equal to the escaped amount in the course of the condensing process.

The polyester resin thus obtained was highly transparent.

[Preparation of Developers]

Yellow, magenta, cyan and black developers were respectively prepared in the following manner by using the above-synthesized polyester resin as binder resins.

A mixture having the following formulation was fused and thoroughly kneaded in a three-roll mill, and then cooled. The resulting mixture was crushed and classified, thereby obtaining a developer having an average particle size of approximately 10 μm.

| <Formulation of Yellow Developer> | parts by weight |
|---|---|
| Polyester Resin | 100 |
| C.I. Pigment Yellow 17 | 5 |
| Chromium complex compound of 3,5-di-tert-butylsalicylic acid (charge controlling agent) | 1 |

The viscoelasticity (tanδ) of the above-prepared yellow developer was 3.4.

| <Formulation of Magenta Developer> | parts by weight |
|---|---|
| Polyester Resin | 100 |
| C.I. Pigment Red 122 | 5 |
| Chromium complex compound of 3,5-di-tert-butylsalicylic acid (charge controlling agent) | 1 |

The viscoelasticity (tanδ) of the above-prepared magenta developer was 3.4.

| <Formulation of Cyan Developer> | parts by weight |
|---|---|
| Polyester Resin | 100 |
| C.I. Pigment Blue 15 | 5 |
| Chromium complex compound of 3,5-di-tert-butylsalicylic acid (charge controlling agent) | 1 |

The viscoelasticity (tanδ) of the above-prepared cyan developer was 3.4.

| <Formulation of Black Developer> | parts by weight |
|---|---|
| Polyester Resin | 100 |
| Carbon Black | 2 |
| Chromium complex compound of 3,5-di-tert-butylsalicylic acid | 1 |

-continued

| <Formulation of Black Developer> | parts by weight |
|---|---|
| (charge controlling agent) | |

The viscoelasticity (tanδ) of the above-prepared black developer was 3.4.

[Preparation of Two-Component Type Developers]

Five parts by weight of the above-prepared yellow developer and 95 parts by weight of a carrier of amorphous oxidation-reduction iron powder were thoroughly mixed in a ball mill pot, thereby obtaining a two-component type yellow developer for use in the present invention.

Magenta, cyan and black two-component type developers for use in the present invention were also prepared by using the above-prepared magenta, cyan and black developers, respectively, in the same manner as described above.

[Printing Test]

Printing test was carried out by using a multi-color printer of a digital type in which were placed the above-prepared two-component type developers of four colors.

In the printer used, a latent image corresponding to one of the separated colors is formed on a photoconductor in accordance with the corresponding digital color signal by using a laser beam with a recording density of 600 dpi, and then developed with the corresponding color developer. The developed toner image is transferred to a transfer sheet. The above procedure is repeated with respect to each of the other colors, and the obtained toner images of four colors are finally superimposed to obtain a multi-color image.

In the image fixing unit of the above printer, a heat-application roller comprising a HTV rubber layer was employed, to which a silicone oil was applied to improve the releasability from the transfer sheet. The nip width of rollers was 9 mm, the linear speed of the roller, 90 mm/sec, and the image-fixing temperature, about 150° C.

It was found that the multi-color images obtained by conducting an 80%-UCR treatment were uniform, and had excellent gradation, free from surface roughness.

In accordance with the Test Method 3 of JIS-Z8781 (1983), the glossiness of the obtained image was measured. As a result, the glossiness, Gs (60°), on a black solid area of the image formed by the black developer was approximately 30% when the toner deposition amount was 1.0 mg/cm$^2$.

Using the above multi-color printer of a digital type, several image samples were prepared by forming a black solid toner layer by the black developer on a polyester film with a thickness of 100 μm, with the toner deposition amount being changed by controlling the potential in the development process.

All the above-prepared image samples had a glossiness ranging from 20 to 40%.

The reflection image density ($ID_{ref}$) and the transmission image density ($ID_{tr}$) of the above image samples were respectively measured by the commercially available reflection type densitometer "RD-914" and transmission type densitometer "TD-904" (Trademark), made by Mcbeth Co., Ltd. The results are shown in Table 1.

COMPARATIVE EXAMPLE 1

[Preparation of Developers]

Yellow, magenta and cyan developers were respectively prepared in the same manner as in Example 1.

The procedure for preparation of a black developer as employed in Example 1 was repeated except that the formulation was changed as follows:

| <Formulation of Black Developer> | parts by weight |
|---|---|
| Polyester Resin (synthesized in Example 1) | 80 |
| Styrene-n-butyl acrylate copolymer | 15 |
| Polypropylene wax | 5 |
| Carbon Black | 2 |
| Chromium complex compound of 3,5-di-tert-butylsalicylic acid (charge controlling agent) | 1 |

The viscoelasticity (tanδ) of the yellow, magenta and cyan developers was 3.5, and that of the above-prepared black developer was 3.1.

[Preparation of Two-Component Type Developers]

Five parts by weight of the above-prepared yellow developer and 95 parts by weight of a carrier of amorphous oxidation-reduction iron powder were thoroughly mixed in a ball mill pot, thereby obtaining a two-component type yellow developer for use in the present invention.

Magenta, cyan and black two-component type developers for use in the present invention were also prepared by using the above-prepared magenta, cyan and black developers, respectively, in the same manner as described above.

[Printing Test]

Printing test was carried out by using the above-prepared four two-component type developers in the same manner as in Example 1. As a result, it was found that the color reproduction of the printed images was poor, and the image quality was thus unsatisfactory.

The glossiness of the printed images was measured by the same method as in Example 1. As a result, the glossiness, Gs (60°), on a black solid area of the image formed by the black developer was approximately 24%, which was within the aforementioned proper range, when the toner deposition amount was 1.0 mg/cm$^2$.

However, it was found that the multi-color image obtained by conducting the UCR treatment was dull.

Using the above multi-color printer of a digital type, several image samples were prepared by the same method as in Example 1. The reflection image density ($ID_{ref}$) and the transmission image density ($ID_{tr}$) of the above image samples were measured by the same densitometers as used in Example 1. The results are shown in Table 1.

COMPARATIVE EXAMPLE 2

[Preparation of Developers]

Yellow, magenta and cyan developers were respectively prepared in the same manner as in Example 1.

The procedure for preparation of a black developer as employed in Example 1 was repeated except that the formulation was changed as follows:

| <Formulation of Black Developer> | parts by weight |
|---|---|
| Polyester Resin (synthesized in Example 1) | 10 |
| Carbon Black | 4 |
| Chromium complex compound of 3,5-di-tert-butylsalicylic acid (charge controlling agent) | 1 |

The viscoelasticity (tanδ) of the yellow, magenta and cyan developers was 3.5, and that of the above-prepared black developer was 3.3.

[Preparation of Two-Component Type Developers]

Five parts by weight of the above-prepared yellow developer and 95 parts by weight of a carrier of amorphous oxidation-reduction iron powder were thoroughly mixed in a ball mill pot, thereby obtaining a two-component type yellow developer for use in the present invention.

Magenta, cyan and black two-component type developers for use in the present invention were also prepared by using the above-prepared magenta, cyan and black developers, respectively, in the same manner as described above.

[Printing Test]

Printing test was carried out by using the above-prepared four two-component type developers in the same manner as in Example 1. As a result, it was found that gradation of the printed images, especially in a highlight portion, was poor, and the image seemed to have surface roughness.

The glossiness of the printed images was measured by the same method as in Example 1. As a result, the glossiness, Gs (60°), on a black solid area of the image formed by the black developer was approximately 28%, which was within the aforementioned proper range, when the toner deposition amount was 1.0 mg/cm$^2$.

However, it was found that the multi-color image obtained by conducting the UCR treatment was dark as a whole, and the gradation in a shadow portion was impaired.

Using the above multi-color printer of a digital type, several image samples were prepared by the same method as in Example 1. The reflection image density ($ID_{ref}$) and the transmission image density ($ID_{tr}$) of the above image samples were measured. The results are shown in Table 1.

TABLE 1

| Example No. | Image Quality* Gradation | Color Reproduction | Surface Roughness | Glossiness (%)** | $ID_{ref}$ A*** (B) | $ID_{tr}$ A*** (B) |
|---|---|---|---|---|---|---|
| Ex. 1 | ◎ | ◎ | ◎ | 30 | 1.06 (2.08) | 0.51 (1.00) |
| Comp. Ex. 1 | o | x | o | 24 | 1.00 (2.02) | 0.60 (1.21) |
| Comp. Ex. 2 | x | x | x | 28 | 1.52 (2.36) | 0.79 (1.34) |

*Image Quality
◎ : excellent
o : good
x : poor
**The glossiness of a solid image formed by the black developer was measured at a toner deposition amount of 1.0 mg/cm$^2$.
***A: At the toner deposition amount of 0.5 mg/cm$^2$.
(B): At the toner deposition amount of 1.0 mg/cm$^2$.

As previously mentioned, the multi-color electrophotographic image formation method of the present invention can produce high quality multi-color images of a digital type with excellent gradation even though the UCR treatment is conducted. The surface roughness of the images can be minimized. In addition, the color reproduction can be improved, so that clear multi-color images can be obtained.

What is claimed is:

1. A multi-color electrophotographic image formation method of a digital type for forming multi-color images comprising the steps of developing latent electrostatic images corresponding to yellow, magenta, cyan and black images separated from an original image with a yellow developer, a magenta developer, a cyan developer and a black developer, respectively to form visible yellow, magenta, cyan and black images, and fixing said visible yellow, magenta, cyan and black images to an image receiving member, with the reflection image density ($ID_{ref}$) and the transmission image density ($ID_{tr}$) of said fixed black images formed by said black developer being in the relationship of $ID_{ref} \geqq 1.8 \times ID_{tr}$ when the deposition of said black developer is 1.0 mg/cm$^2$ or less.

2. The multi-color electrophotographic image formation method as claimed in claim 1, wherein the reflection image density ($ID_{ref}$) of said black images formed by said black developer meets the relationships of: $0.8 < ID_{ref} < 1.3$ when the deposition of said black developer is 0.5 mg/cm$^2$, and $1.6 < ID_{ref} < 2.4$ when the deposition of said black developer is 1.0 mg/cm$^2$.

3. The multi-color electrophotographic image formation method as claimed in claim 1, wherein said black images formed by said black developer have a glossiness (Gs 60°) of more than 10% and less than 50% when the deposition of said black developer is 1.0 mg/cm$^2$.

4. The multi-color electrophotographic image formation method as claimed in claim 1, wherein said latent electrostatic images corresponding to yellow, magenta, cyan and black images are formed by the steps of separating the colors of said original image, photoelectrically converting said colors into respective color signals, subjecting said color signals to an A/D conversion, and subjecting the A/D converted signals to an operation to form said latent electrostatic images.

5. The multi-color electrophotographic image formation method as claimed in claim 4, wherein an undercolor removal treatment (UCR) is performed during said operation with an undercolor removal ratio of 40 to 100% in terms of image density.

6. The multi-color electrophotographic image formation method as claimed in claim 1, wherein said black developer has a viscoelasticity (tanδ) of more than 2.8 and less than 3.8 at a storage modulus ($G'(\omega)$) of $10^5$ dyn/cm$^2$.

7. The multi-color electrophotographic image formation method as claimed in claim 1, wherein said black developer comprises a binder resin and a coloring agent.

8. The multi-color electrophotographic image formation method as claimed in claim 7, wherein said black developer further comprises a charge controlling agent.

9. The multi-color electrophotographic image formation method as claimed in claim 7, wherein said binder resin is a polyester resin.

10. The multi-color electrophotographic image formation method as claimed in claim 7, wherein said coloring agent is selected from the group consisting of carbon black, aniline black, furnace black and lamp black.

11. The multi-color electrophotographic image formation method as claimed in claim 1, wherein each of said developers is a one-component type developer.

12. The multi-color electrophotographic image formation method as claimed in claim 1, wherein each of said developers can serve as a developer component of a two-component type developer comprising a developer component and a carrier component.

* * * * *